United States Patent [19]

Lenius et al.

[11] Patent Number: 4,958,804

[45] Date of Patent: Sep. 25, 1990

[54] LAWN MOWER SERVICE LIFT

[76] Inventors: Robert R. Lenius, 1524 Weise, Green Bay, Wis. 54302; Steven M. Barlament, 1836 Lenwood Ave., Green Bay, Wis. 54313

[21] Appl. No.: 362,588

[22] Filed: Jun. 7, 1989

[51] Int. Cl.[5] ..... B66F 3/00

[52] U.S. Cl. ..... 254/120; 248/166

[58] Field of Search ..... 254/120, 122, 123, 124, 254/10 R, 10 C; 248/166, 436; 211/81, 96, 168

[56] References Cited

U.S. PATENT DOCUMENTS

| | | | |
|---|---|---|---|
| 651,773 | 6/1900 | Smith | 248/166 |
| 919,353 | 4/1909 | Holly | 248/166 |
| 1,130,760 | 3/1915 | Paffrath | 248/436 |
| 1,179,623 | 4/1916 | Gerrish | 248/166 |
| 1,961,394 | 6/1934 | Rothe | 248/166 |
| 2,250,964 | 7/1941 | Poor et al. | 254/86 |
| 3,223,251 | 12/1965 | Rothe et al. | 254/120 |
| 3,279,754 | 10/1966 | Rizzuto | 254/86 |

*Primary Examiner*—J. J. Hartman

*Attorney, Agent, or Firm*—Jerry T. Kearns

[57] ABSTRACT

A lawn mower service lift has a mower supporting frame mounted for pivotal movement between raised and lowered positions on a base frame by a parallelogram linkage. A stop rail maintains the support frame in the raised position by abutting the parallelogram linkage in an over center position. The supporting frame lies between parallel side rails of the base frame which serve as a guide track to properly align a lawn mower on the supporting frame. The device is useful in performing repair and maintenance on push-type rotary lawn mowers.

1 Claim, 3 Drawing Sheets

LAWN MOWER SERVICE LIFT

BACKGROUND OF THE INVENTION

1. Field of the Invention

The present invention relates to lifting devices, and more particularly pertains to a lifting device for performing repair and maintenance on conventional push-type rotary lawn mowers. These lawn mowers typically utilize an internal combustion engine to drive a rotary cutting blade. In order to perform repair and maintenance work on such lawn mowers, an individual must bend over and must also frequently lift or tip the mower to gain access to the cutting blade. This causes back strain and inconvenience to the servicing individual and additionally poses a safety hazard. In order to enable such repair and maintenance operations to be more conveniently performed, the present invention provides an inexpensive manually operated lifting device for moving such lawn mowers between raised and lowered positions.

2. Description of the Prior Art

Various types of lifting devices are known in the prior art. A typical example of such a lifting device is to be found in U.S. Pat. No. 2,250,964, which issued to T. Poor et al on July 29, 1941. This patent discloses a tractor lifting jack having a pivotal linkage connected for actuation by a hydraulically actuated draw bar of the tractor. U.S. Pat. No. 3,279,754, which issued to C. Rizzuto on Oct. 18, 1966, discloses a pivotal lifting device for use with baby carriages which includes front and rear leg support bars connected by pivotal side rails.

While the above mentioned devices are directed to lifting devices, none of these devices are suitable for use in lifting a push-type lawn mower for performing repair and maintenance operations thereon. Inasmuch as the art is relatively crowded with respect to these various types of lifting devices, it can be appreciated that there is a continuing need for and interest in improvements to such lifting devices, and in this respect, the present invention addresses this need and interest.

SUMMARY OF THE INVENTION

In view of the foregoing disadvantages inherent in the known types of lifting devices now present in the prior art, the present invention provides an improved lawn mower service lift. As such, the general purpose of the present invention, which will be described subsequently in greater detail, is to provide a new and improved lawn mower service lift which has all the advantages of the prior art lifting devices and none of the disadvantages.

To attain this, a representative embodiment of the concepts of the present invention is illustrated in the drawings and makes use of a lawn mower service lift having a mower supporting frame mounted for pivotal movement between raised and lowered positions on a base frame by a parallelogram linkage. A stop rail maintains the support frame in the raised position by abutting the parallelogram linkage in an over center position. The supporting frame lies between parallel side rails of the base frame which serve as a guide track to properly align a lawn mower on the supporting frame. The device is useful in performing repair and maintenance on push-type rotary lawn mowers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lawn mower service lift which has all the advantages of the prior art lifting devices and none of the disadvantages.

It is another object of the present invention to provide a new and improved lawn mower service lift which may be easily and efficiently manufactured and marketed.

It is a further object of the present invention to provide a new and improved lawn mower service lift which is of a durable and reliable construction.

An even further object of the present invention is to provide a new and improved lawn mower service lift which is susceptible of a low cost of manufacture with regard to both materials and labor, and which accordingly is then susceptible of low prices of sale to the consuming public, thereby making such lifting devices economically available to the buying public.

Still yet another object of the present invention is to provide a new and improved lawn mower service lift which provides in the apparatuses and methods of the prior art some of the advantages thereof, while simultaneously overcoming some of the disadvantages normally associated therewith.

Still another object of the present invention is to provide a new and improved lawn mower service lift which enables individuals to perform repair and maintenance operations on pushtype lawn mowers without incurring inconvenience or back strain.

Yet another object of the present invention is to provide a new and improved lawn mower service lift which is of an inexpensive construction and enables individuals to manually move a push-type lawn mower between raised and lowered positions.

Even still another object of the present invention is to provide a new and improved lawn mower service lift incorporating alignment and stop features for properly locating a push-type lawn mower on a supporting frame and for maintaining the supporting frame in a raised position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
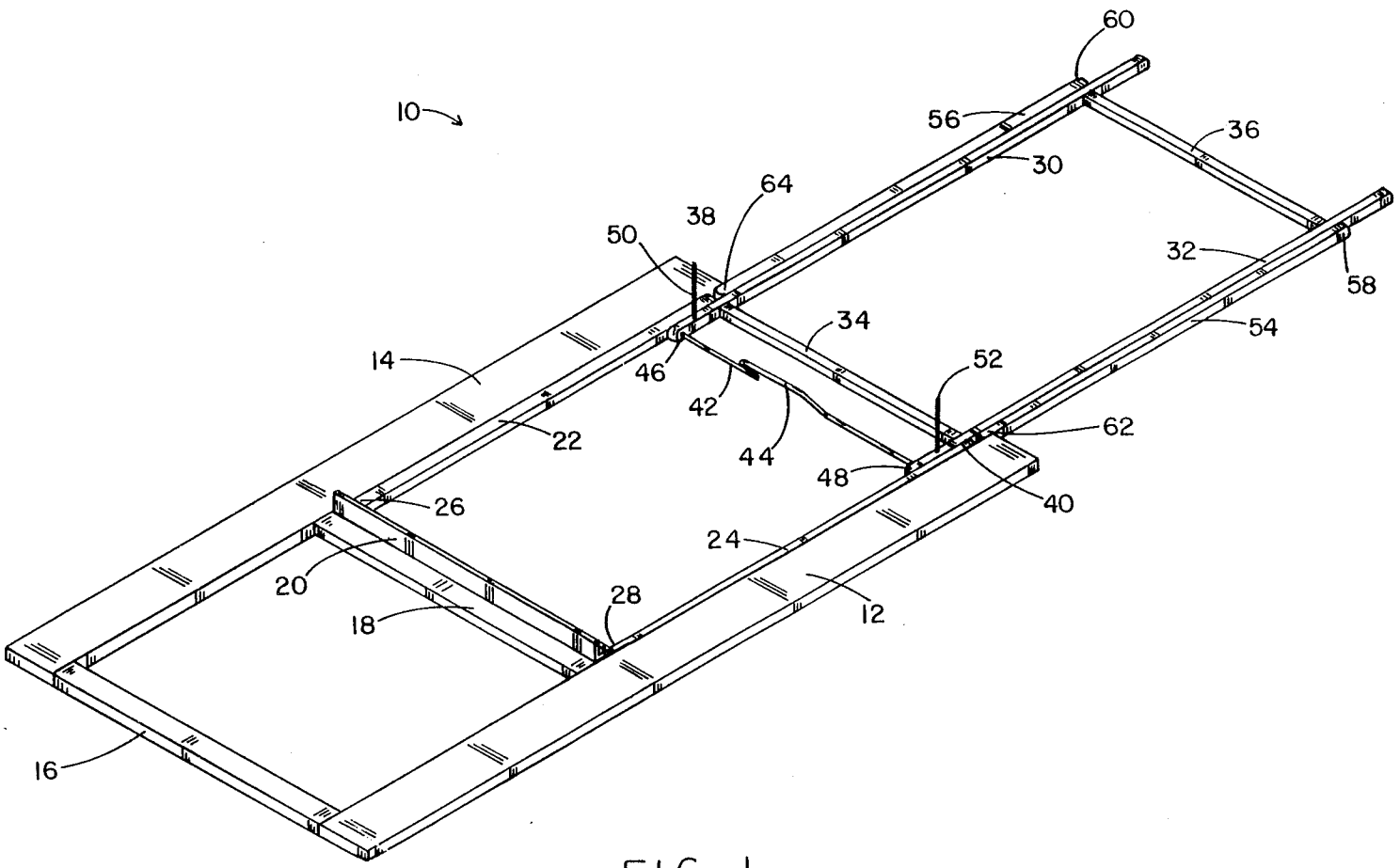
FIG. 1 is a perspective view of the lawn mower service lift of the present invention, in a lowered position.

With reference now to the drawings, and in particular to FIG. 1 thereof, a new and improved lawn mower service lift embodying he principles and concepts of the present invention and generally designated by the reference numeral 10 will be described.

More specifically, it will be noted that the first embodiment 10 of the invention includes an open ended rectangular base frame formed by two parallel side rails 12 and 14 connected by a transverse end rail 16 and an intermediate transverse support rail 18. A rectangular support frame is formed by parallel side frame members 30 and 32 rigidly connected by end frame members 34 and 36. A pair of vertically upstanding stop members 50 and 52 are secured in aligned relation on end portions of the frame members 30 and 32 and serve as abutment stops to orient a push-type lawn mower in correct position over the support frame. Four struts 22, 24, 54 and 56 each have a first end 38, 40, 58 and 60 pivotally connected adjacent a corner portion of the support frame and a second end 26, 28, 62 and 64 pivotally connected to the base frame rails 12 and 14. Preferably, low friction pivot bearings are utilized to form these connections, to allow manual operation of the lift with a minimum of effort. The four struts 22, 24, 54 and 56 form a parallelogram linkage mounting the support frame for movement between the illustrated lowered position and a raised position. The support frame lies between the base frame rails 12 and 14 in the illustrated lowered position. The base frame rails 12 and 14 are spaced apart a predetermined space to form a guide track for the wheels of a push-type lawn mower to ensure proper alignment of the mower over the support frame. An upstanding transverse stop rail 20 is secured between the struts 22 and 24, and is dimensioned to abut the intermediate support rail 18 of the base frame in an over center position to maintain the support frame in a raised position. The stop rail 20 is formed from a length of right angle steel stock material, and also serves as a reinforcing member between the pivotal struts 22 and 24. A handle 44 is formed by a bent rectangular portion of a steel rod 42. End portions 46 and 48 of the handle rod 42 are mounted for pivotal movement between forward end portions of the support frame members 30 and 32. The handle 44 allows manual movement of the support frame between raised and lowered positions. The pivotal mounting of the handle 44 allows the handle to be maintained in a correct angular orientation during arcuate movement of the support frame.

Figure 2:
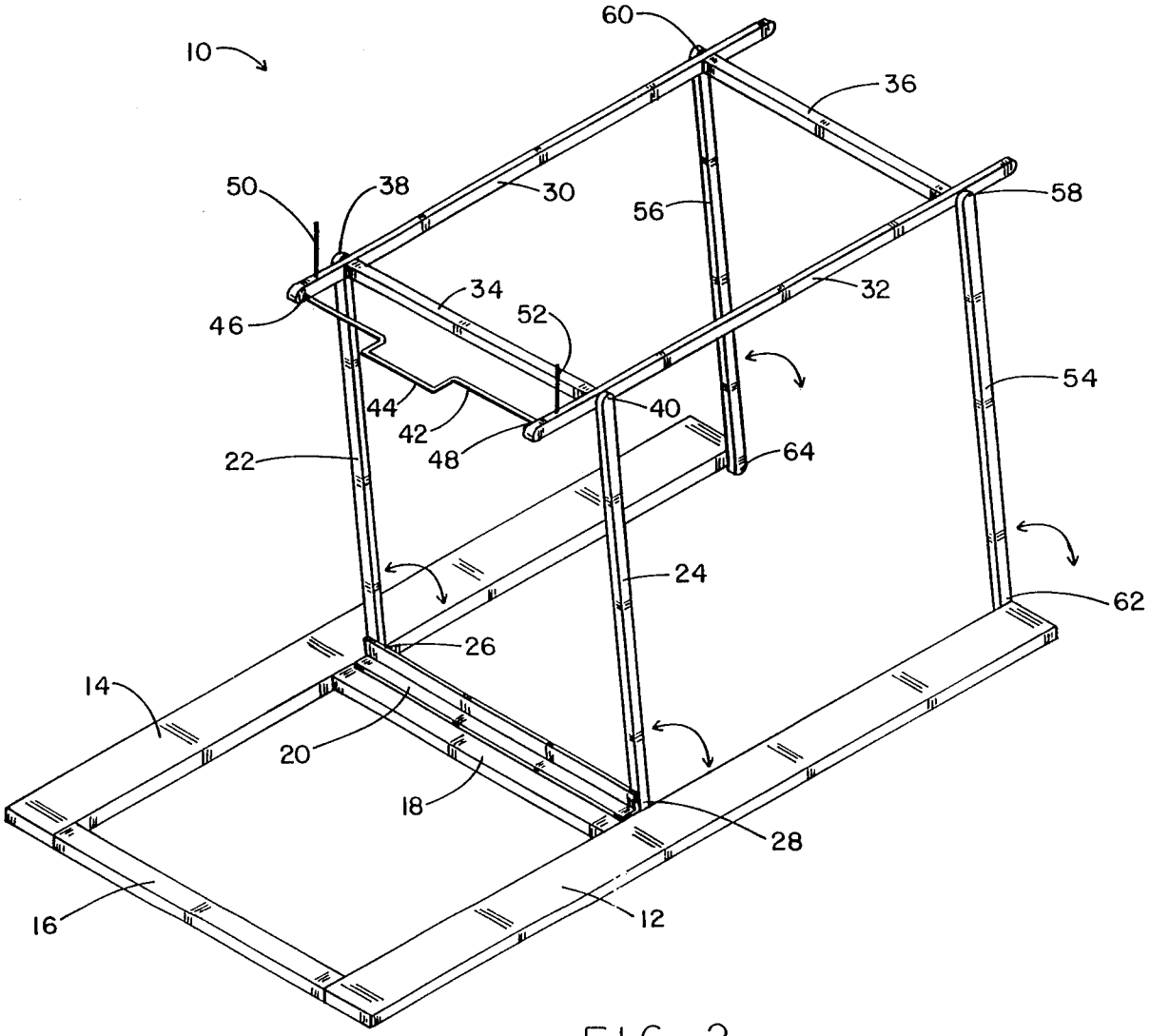
FIG. 2 is a perspective view of the lawn mower service lift of the present invention, in a raised position.

FIG. 2 illustrates the support frame disposed in a raised position. The illustrated arrows indicate the arcuate movement of the pivotal struts, which in effect form a parallelogram linkage.

Figure 3:
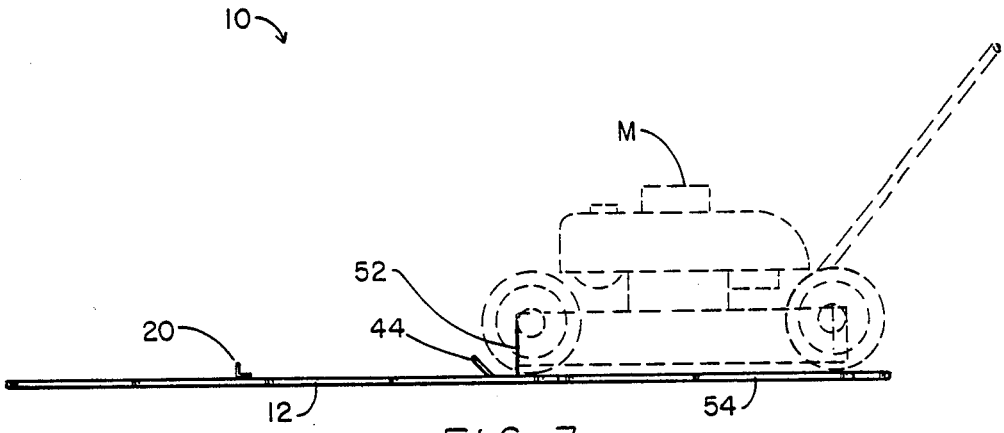
FIG. 3 is a side view illustrating the lawn mower service lift of the present invention in a lowered position, with a push-type lawn mower positioned thereon.

FIG. 3 is a side view which illustrates a conventional push-type lawn mower M disposed over the support frame, prior to movement to a raised position.

Figure 4:
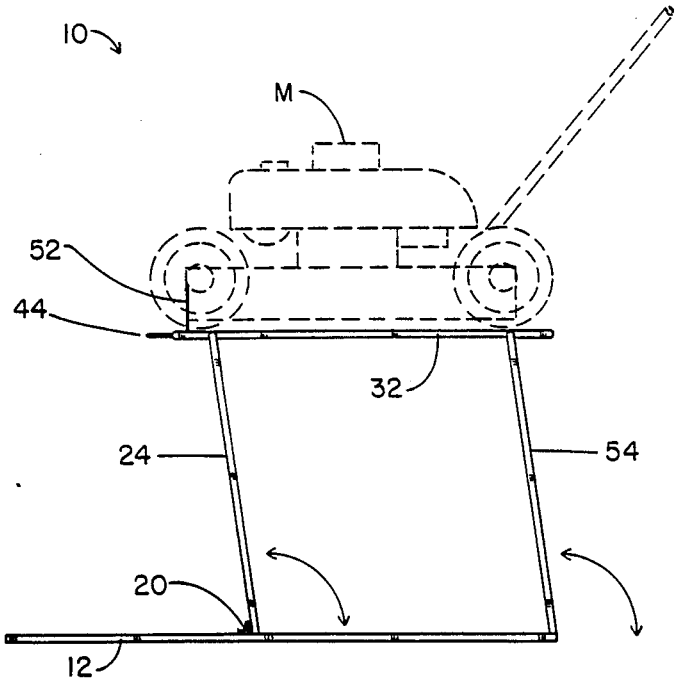
FIG. 4 is a side view illustrating the lawn mower service lift of the present invention in a raised position, with a lawn mower supported thereon.

FIG. 4 illustrates the mower M supported on the support frame in a raised position. The length of the four support struts determines the height of the mower M in a raised position. Of course, the mower M should be shut off before movement to a raised position, to eliminate exposure of the rotating mower blade. In the illustrated raised position, the mower blade may easily removed for sharpening, and other service operations such as oil changing or spark plug changing may be conveniently performed. Additionally, because of the parallelogram linkage, an individual may more easily move the mower M to a raised position, as compared with a straight up manual lifting to the surface of a conventional table or work bench. The parallelogram linkage provides a mechanical lever force advantage which minimizes the possibility of back injury to an individual performing these service operations. As shown, the stop rail 20 is secured to two of the pivotal struts, one of which 24 is illustrated, and abuts the support rail 18 (FIG. 2), thus maintaining the support frame in the raised position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A lawn mower service lift, comprising:

an open ended rectangular base frame formed by two parallel side rails connected by a transverse end rail and an intermediate transverse support rail;

a rectangular support frame;

a pair of vertically upstanding stop members secured adjacent one end of said support frame for positioning a lawn mower thereon;

four struts each having a first end pivotally connected adjacent a corner portion of said support frame and a second end pivotally connected to said base frame, said four struts forming a parallelogram linkage and mounting said support frame for movement through said open end of said base frame between raised and lowered positions;

said support frame lying between said parallel side rails of said base frame in said lowered position, said base frame side rails spaced apart a predetermined distance to form a guide track for alignment of a lawn mower on said support frame;

an upstanding transverse stop rail secured between two of said four pivotal struts, said stop rail dimensioned to abut said intermediate transverse support rail in an over center position to maintain said support frame in said raised position;

and a handle pivotally secured to said support frame for movement about a pivot axis parallel to pivot axes of each of said four pivotal struts, to facilitate manual movement of said support frame between said raised and lowered position.

* * * * *